United States Patent [19]

Hayward

[11] Patent Number: 4,797,121

[45] Date of Patent: Jan. 10, 1989

[54] COAXIAL CABLE FITTING

[75] Inventor: Robert D. Hayward, Phoenix, Ariz.

[73] Assignee: Gilbert Engineering Company, Inc., Phoenix, Ariz.

[21] Appl. No.: 168,890

[22] Filed: Mar. 9, 1988

[51] Int. Cl.[4] ..... H01R 17/04

[52] U.S. Cl. ..... 439/579

[58] Field of Search ..... 439/577–585

[56] References Cited

U.S. PATENT DOCUMENTS 2,813,144 11/1957 Valach ..... 439/579

3,728,666 4/1973 Shirey ..... 439/579

*Primary Examiner*—Joseph H. McGlynn

*Attorney, Agent, or Firm*—Don J. Flickinger; Jordan M. Meschkow

[57] ABSTRACT

A specially configured "tee" fitting for tapping into a coaxial cable network is disclosed. The fitting includes a conductive block having a cylindrical channel extending between aligned first and second openings and a passage extending between a third opening and the channel at a right angle to the channel. Cylindrical insulators are fitted into the channel at the openings, and each insulator has a central aperture for receiving the ends of a conductive double-ended pin unit. A central region of the pin unit extends between the first and second end regions, the end regions each having a coaxial blind hole. A coaxial cable connector assembly component includes a nipple adapted to be threaded into the passage and an outwardly directed coaxial cable connector which extends through by the nipple. The cable connector assembly also includes an inwardly directed spring biased center pin which is connected to the inner conductor coupling components of the coaxial cable connector and bears, at its outboard end, against the double-ended pin unit. The system bus is coupled across the fitting by providing permanent securance (as by crimping a crimp ring) to the abutting bus coaxial cable ends in such a manner that the center conductors of the cable ends extend into the blind holes and their outer conductors are placed in electrical contact with the block. Upon abandonment of a station, the entire cable connector assembly may be removed from the fitting and replaced with a threaded cap-off plug.

4 Claims, 2 Drawing Sheets

COAXIAL CABLE FITTING

FIELD OF THE INVENTION

This invention relates to the electronic information transfer arts and, more particularly, to a coaxial cable fitting adapted to tap into the coaxial system bus of a multi-user system such as a local area network.

BACKGROUND OF THE INVENTION

Many hard-wired information transfer systems employ coaxial cable as the system bus with taps into the bus being made as required to couple a station into the system. One particularly important application for coaxial cable taps is found in so-called local area networks in which a plurality of terminals or computers are coupled together to share the cumulative hardware/software/file capabilities of the system. In a typical local area network, taps into the system bus are effected by employing a "tee" coaxial cable adapter in conjunction with conventional coaxial cable connectors in order to join three lengths of coaxial cable; viz., two within the system bus and one to the terminal or local computer.

Those skilled in the art have become familiar with several problems which arise from this conventional approach to tapping into a local area network. (1) The system bus of a local area network must not be opened electrically during operation since this action will bring the entire system to undesirable (even potentially catastrophic) halt. (2) While skilled technical personnel familiar with the operation of a local area network will ordinarily recognize the correct terminal to disengage or engage when trying to connect or disconnect a terminal from the system bus, it is not at all obvious to the general office worker such that a very real danger exists of system disruption resulting from disconnecting the wrong cable from a fitting. (3) When a terminal is disengaged and "abandoned", the open terminal remaining, even if the disconnection has been correctly performed, presents a locally changed characteristic impedance on the system bus, a condition which can adversely affect the remaining network from transferring information reliably, particularly at higher data transmission rates. (4) When one terminal is to be replaced by another terminal which employs a different coaxial cable connector, the system must be shut down to change the "tee" to a different configuration. The present invention addresses all these well known problems and others of the prior art local area network taps.

OBJECTS OF THE INVENTION

It is therefore a broad object of this invention to provide an improved fitting for providing a tap into a coaxial cable information transfer system such as a local area network.

It is another object of this invention to provide such a fitting which is permanently emplaced whether or not the terminal to which it is coupled remains in the system or is abandoned.

It is yet another object of this invention to provide such a fitting in which the type of connector utilized by the coaxial cable to the tapped-in subsystem can be readily accommodated and changed at will without disturbing the transmission network.

It is still yet a further object of this invention to provide such a fitting which does not present an impedance change to the transmission network upon abandonment of a station.

It is still yet another object of this invention to provide such a fitting which is resistant to inadvertent or intentional tampering.

In another aspect, it is an object of this invention to provide such a fitting which requires no unique tools to install, for which no soldering is required and which is very reliable and non-disruptive to the transmission system in long term use.

SUMMARY OF THE INVENTION

Briefly, these and other objects of the invention are achieved by a specially configured "tee" fitting for tapping into a coaxial cable network. The fitting includes a block fabricated from a conductive material and having a cylindrical channel extending between coaxially aligned first and second openings and a passage extending between a third opening and the channel at a right angle with respect to the cylindrical channel. Cylindrical insulators are fitted into the cylindrical channel at the first and second openings, and each insulator has a central aperture for receiving the respective ends of a double-ended pin unit which is also fabricated from a conductive material. A central region of the pin unit extends between the first and second end regions, the end regions each having a coaxial center-conductor-receiving blind hole. A removable coaxial cable connector assembly includes a nipple adapted to be closely removably received (as by threaded engagement) within the passage and an outwardly directed conventional coaxial cable connector which extends through and is supported by the nipple. The cable connector assembly also includes an inwardly directed and inwardly spring biased center pin which is connected to the inner conductor coupling components of the coaxial cable connector and bears, at its outboard end, against the central region of the double-ended pin unit. The system bus is coupled across the fitting by providing permanent securance to first and second abutting bus coaxial cable ends in such a manner that the center conductors of the cable ends extend into the first and second blind holes and their outer conductors are placed in electrical contact with the block. In one presently preferred embodiment, the permanent connection is achieved at each junction by appropriately positioning the cable ends to the fitting and crimping an elongated crimp ring which encompasses both the outer insulating sleeve of the cables and the outer braid conductor which is pressed between the sleeve and a barbered outer surface of a tubular guide component of a cable coupling body. Upon abandonment of a station, the entire cable connector assembly may be removed from the fitting and replaced with a cap-off plug.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE PREFERRED EMBODIMENTS

Figure 1:
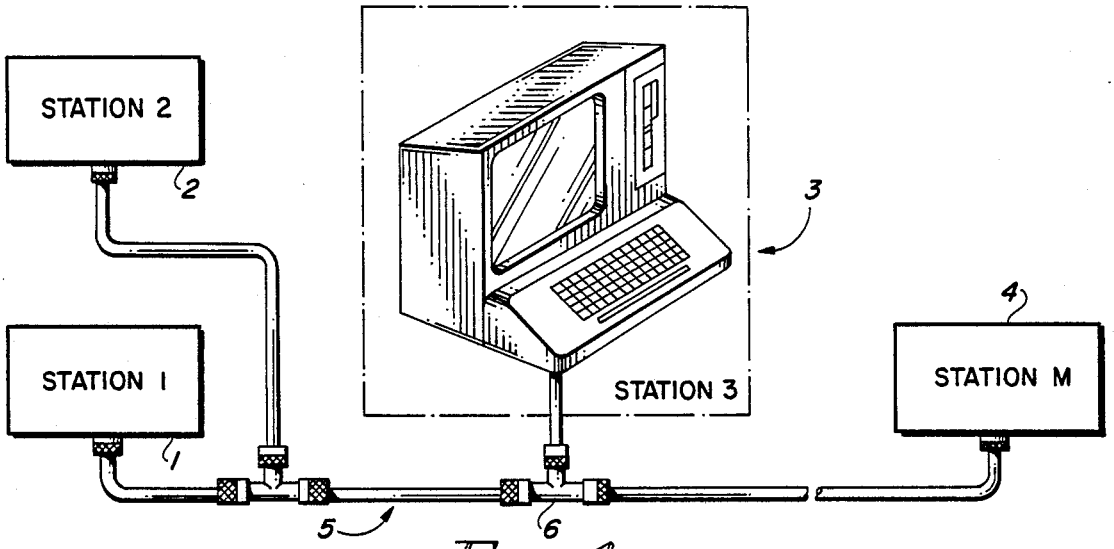
FIG. 1 (PRIOR ART)
FIG. 1 is a block diagram in partially pictorial representation of a typical local area network illustrating in exemplary fashion a prior art approach to providing coaxial cable between the individual terminals and the system coaxial cable bus.

Referring first to FIG. 1, there is shown a typical conventional local area network in which a first station 1, a second station 2, a third station 3 and any number of additional stations, up to and including an nth station 4, are all interconnected via a coaxial cable system bus 5. As those skilled in the art are well aware, each station (which may be a terminal or a computer as represented at the third station 3) is connected to the system coaxial bus 5 in order that the several stations of the local area network) may share hardware/software capabilities and files by exchanging information among themselves serially on the bus 5. Except for the first and last stations, all the stations are coupled to the system bus 5 by coaxial cable "tee" fittings such as the fitting 6.

Figure 2:
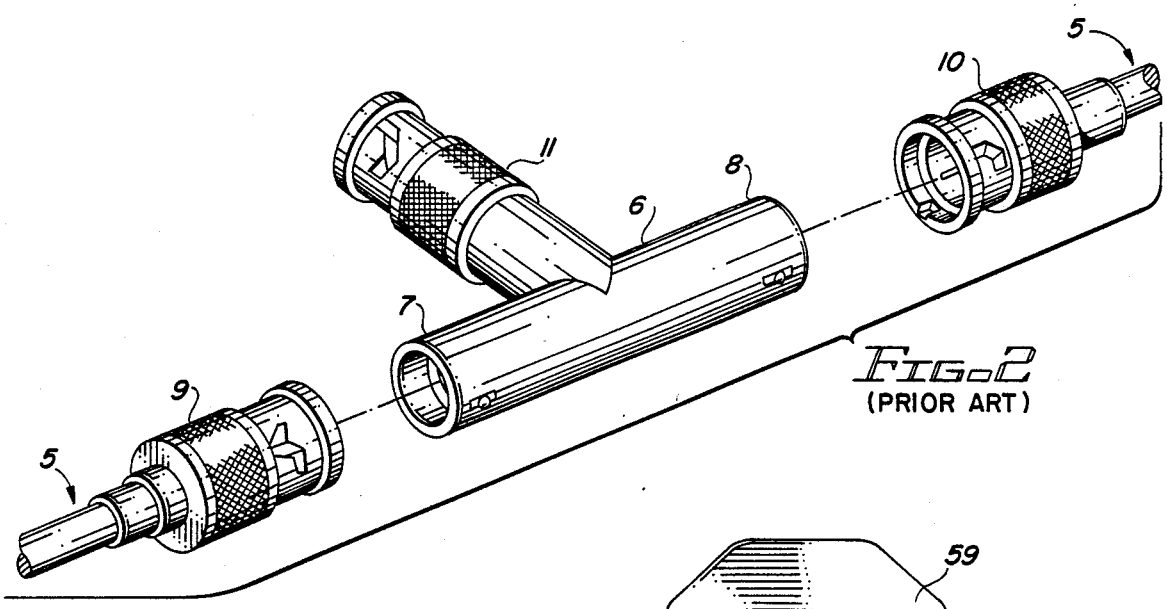
FIG. 2 (PRIOR ART)
FIG. 2 is an enlarged view illustrating, in more detail, a conventional "tee" fitting employed in the local area network to tap a terminal into the system bus.

FIG. 2 illustrates a typical prior art configuration for the "tee" fitting 6 which, in this instance, constitutes female connectors 7, 8 for receiving the male connectors 9, 10 of the system bus 5. For this disclosure, gender is determined by the relationship of the maiting inner conductors. A male connector 11 extends at right angles to the female connectors 7, 8 and is thus adapted to receive a female connector to couple a coaxial cable from a station into the system bus 5. Those skilled in the art will appreciate that, while common BNC connectors are illustrated in FIG. 2, other conventional coaxial cable coupling configurations are also employed in this application, and the male/female relationship at each junction may be reversed. Typically, however, for the "tee" fitting 6, the connectors 7, 8 are the same and the connector 11 the opposite gender in order to limit the chance of mistakenly interrupting the system bus 5 when it is only desired to disconnect a station cable. Nonetheless, as is notoriously well known in the art, cable connections are often mishandled during connection and disconnection of terminals.

Figure 5:
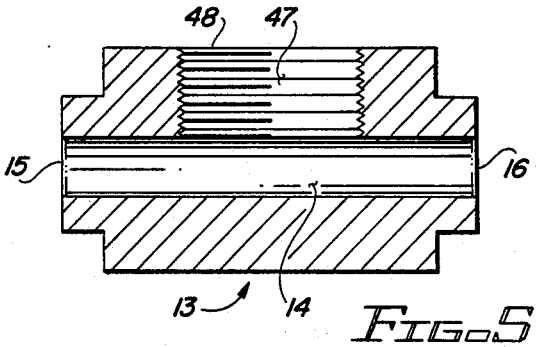
FIG. 5 illustrates the basic structure of a block component around which the fitting is assembled.
Figure 3:
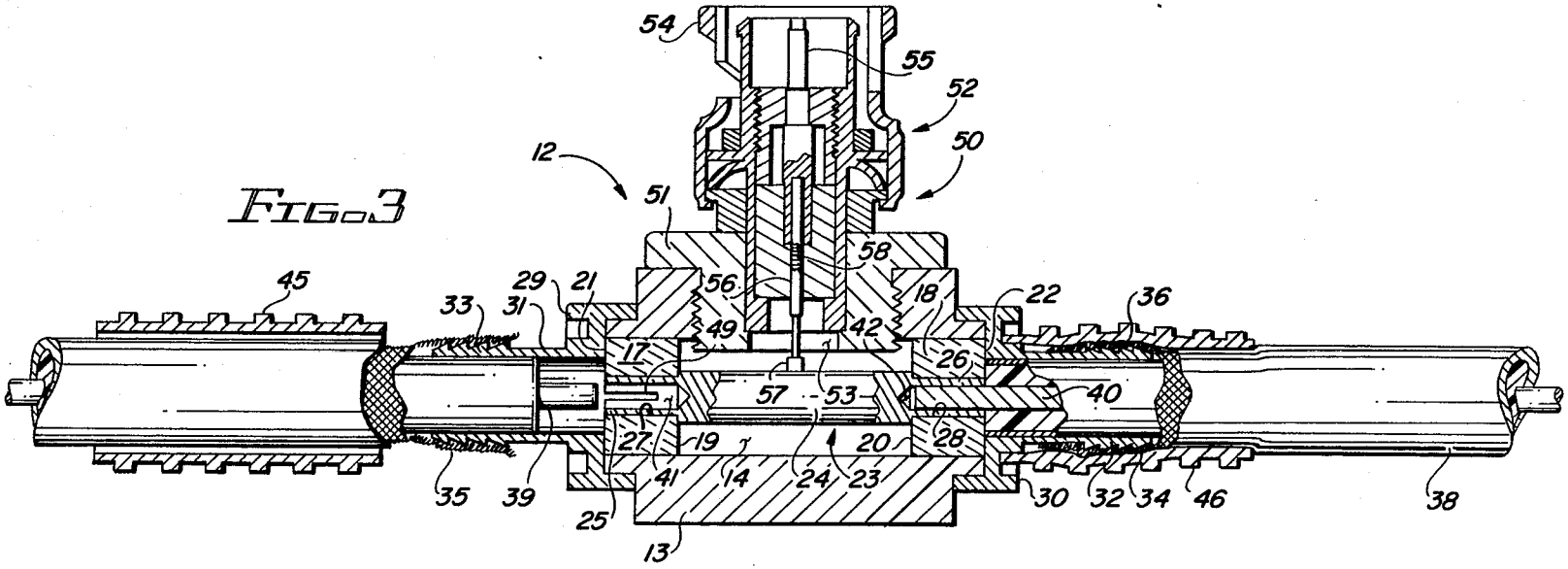
FIG. 3 is a predominantly cross sectional view of a "tee" fitting according to the present invention.

Attention is now directed to FIG. 3 which illustrates, in one exemplary configuration, the subject coaxial cable "tee" fitting 12 by the use of which, in a local area network or the like, the several enumerated drawbacks to the prior art "tee" fittings have been eliminated. The fitting 12 has several components including a block 13 which is fabricated from a conductive material such as aluminum or brass. Referring briefly to FIG. 5, the construction of the block 13 may be more easily understood. The block 13 has a cylindrical channel 14 extending between coaxially aligned first 15 and second 16 openings, and a passage 47 extends between a third opening 48 and the cylindrical channel 14. The axis of the passage 47 is disposed at right angles with respect to the axis of the first and second openings 15, 16. Preferably, the cylindrical wall of the passage 47 is internally threaded as shown.

Referring again to FIG. 3, first 17 and second 18 cylindrical insulators have outside diameters dimensioned to be closely received within the cylindrical chamber 14 and extend, respectively, between inside faces 19, 20 and outside faces 21, 22 which are situated at or near the openings 15, 16. A double-ended pin unit 23 having a central region 24 extending between reduced diameter first 25 and second 26 end regions is supported concentrically within the channel 14 by virtue of the end regions 25, 26 extending into central apertures 27, 28 provided coaxially through, respectively, the insulators 17, 18. Coaxial blind holes 41, 42 are respectively provided in the end regions 25, 26, and longitudinal slots (typically, two or four) may be employed to obtain a resilient female receptacle action at each of the blind holes.

First 29 and second 30 coaxial cable coupling bodies are affixed to the block 13 adjacent the first 15 and second 16 openings and are each adapted to permanently secure a coaxial cable end to the block such that inner conductors of the coaxial cable ends extend into the blind holes 41, 42 and the coaxial cable outer conductors are brought into electrical contact with the block. The coupling bodies 29, 30 include outwardly extending tubular guides 31, 32 which are coaxially aligned with the double-ended pin unit 23. Tubular guide elements 31, 32 of the coupling bodies 29, 30 are provided with outwardly directed circumferential barbs 33, 34 over which outer conductors 35, 36 of coaxial cables 37, 38 may be introduced as part of the installation process for incorporating the subject fitting into a system bus.

During the installation process, the inner conductors 39, 40 of the coaxial cables 37, 38 are inserted into the blind holes 41, 42 and are thus conductively engaged with the double-ended pin unit 23 and with one another. As shown in FIG. 3, the coaxial cable 38 is already permanently joined to the fitting 12 by a crimp ring 46 which has been squeezed, using an appropriate tool, about the tubular guide 32 and the coaxial cable 38. The coaxial cable 37 is illustrated in FIG. 3 in the process of being pushed into place prior to sliding the elongated crimp ring 45 into place for subsequent crimping to effect permanent attachment of the coaxial cable 37 to the fitting 12.

A removable coaxial cable connector assembly 50 includes a nipple 51 to be closely received within the passage 47 (FIG. 5) as by threaded engagement. A standard coaxial cable connector 52 (exemplarily shown as a BNC connector) includes conventional outer conductor coupling 54 and inner conductor coupling 55 media. The connector 52 is affixed to and supported by the nipple 51, and its lower region extends through a central opening 53 in the nipple. An inwardly directed center pin 56 is electrically connected to the inner conductor coupling medium 55 and has a bearing end 57 which is spring loaded against the central region 24 of the double-ended pin unit 23 to make electrical conduct therewith. The bearing end 57 is spring-biased against the pin unit 23 by a compression spring 58 or equivalent structure.

In use, the coaxial cables 37, 38 constitute sections of the system bus line and, once they have been permanently affixed to the fitting 12, cannot be manually separated to break the bus line. A coaxial cable to a terminal may be directly coupled to the fitting 12 by selecting the appropriate coaxial cable connector 52 which is already secured to its externally threaded nipple 51. Thus, the configuration of the "tee" fitting 12 may be completed by screwing in a coaxial cable connector assembly appropriate for a given installation. Alternatively, those skilled in the art will appreciate that the threaded connection may be replaced by a press fit or bonded assembly, but the threaded configuration is preferred for reasons which will become apparent below.

Figure 6:
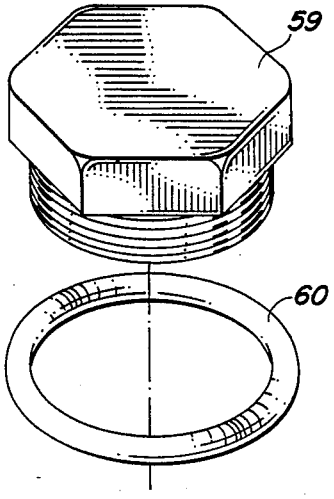
FIG. 6 illustrates use of a cap-off plug which may be employed with the subject fitting as shown in FIG. 4.
Figure 4:
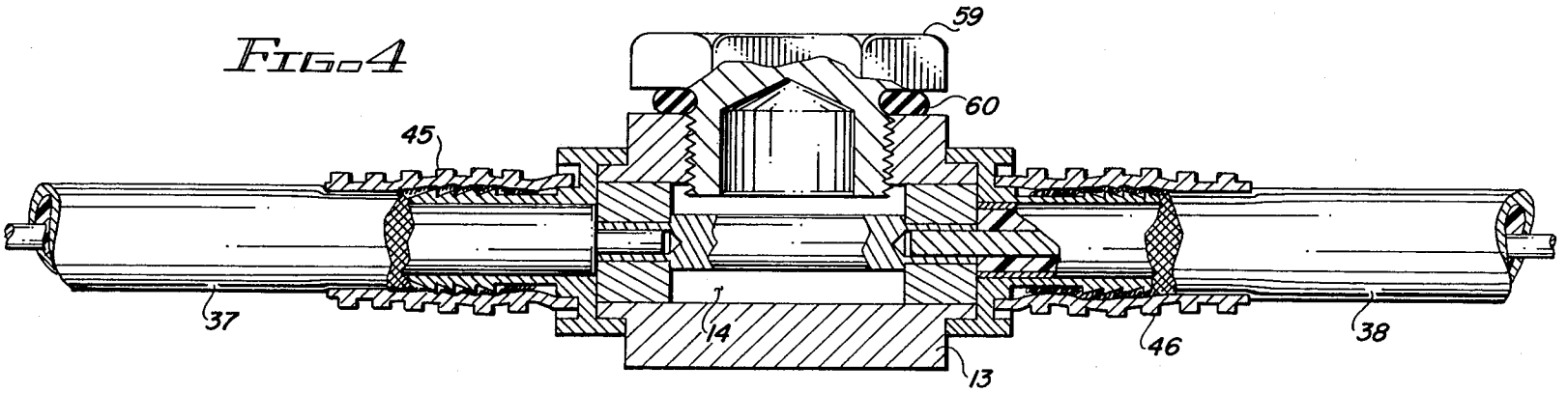
FIG. 4 illustrates a reconfiguration of the fitting shown in FIG. 3 as occasioned before the installation of or after the removal of a tap to the system bus.

Consider now the case in which it is desired to make provision for a future terminal by establishing a tapping point or the similar situation in which it is desired to abandon a terminal without otherwise disturbing the system bus line. As shown in FIG. 4 (and also referring to FIG. 6), after the nipple 51 has been removed (it being impossible to manually remove the system bus connections) or before it has been emplaced, an externally threaded cap-off plug 59 may be substituted to close off access to the cylindrical channel 14 without otherwise disturbing the system bus of which the coaxial cables 37 and 38 are components. If desired, an O-ring seal 60 may be employed to make the connection weather tight. It will be clear from a comparison of FIGS. 3 and 4 that whenever a terminal is to be subsequently installed or reinstalled, it is only necessary to remove the cap-off plug 59 and replace it with the removable coaxial cable connector assembly 50 to again obtain the orientation illustrated in FIG. 3. During periods in which the cap-off plug 59 is in place (FIG. 4), the physical configuration of the fitting is such that the characteristic impedance observed locally is very close to that of the cable itself, and therefore there is no disturbance to or deterioration of the overall bus system performance.

The use of the subject "tee" fitting is not, of course, limited to local area networks, and other applications, such as distribution systems for cable television, are contemplated.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A fitting for tapping into a coaxial cable network comprising:

(A) a block fabricated from a conductive material, said block including:
  1. a cylindrical channel extending between coaxially aligned first and second openings; and
  2. a passage extending between a third opening and said channel, said passage having an axis disposed at right angles with respect to the axis of said first and second openings;

(B) first and second cylindrical insulators having outside diameters dimensioned to be closely received within said cylindrical chamber, each of said first and second insulators extending between an inside face and an outside face;
  1. said first cylindrical insulator being positioned within said cylindrical chamber with its said outside face disposed proximate said first opening;
  2. said second cylindrical insulator being positioned within said cylindrical chamber with its said outside face disposed proximate said second opening;
  3. a first central aperture extending coaxially through said first insulator; and
  4. a second central aperture extending coaxially through said second insulator;

(C) a double-ended pin unit fabricated from a conductive material, said pin unit:
  1. having a central region and first and second end regions, said central region extending between said first and second end regions;
  2. said first and second end regions extending, respectively, into said first central aperture and into said second central aperture such that said pin unit is supported coaxially within said chamber;
  3. a first coaxial center-conductor-receiving blind hole in said first end region; and
  4. a second coaxial center-conductor-receiving blind hole in said second end region;

(D) a removable coaxial cable connector assembly comprising:
  1. a nipple adapted to be closely removably received within said passage; and
  2. an outwardly directed conventional coaxial cable connector extending through and supported by said nipple, said connector including:
     a. outer conductor coupling means; and
     b. inner conductor coupling means; and
  3. an inwardly directed and inwardly spring biased center pin, said center pin:
     1. being electrically connected to said inner conductor coupling means; and
     2. bearing at one end on said central region of said pin unit;

(E) first coaxial cable coupling means adapted to permanently secure a first bus coaxial cable end to said block such that a center conductor of said first bus coaxial cable end extends into said first center-conductor-receiving blind hole and an outer conductor of said first bus coaxial cable end is in electrical contact with said block; and (F) second coaxial cable coupling means adapted to permanently secure a second bus coaxial cable end to said block such that a center conductor of said second bus coaxial cable end extends into said second center-conductor-receiving blind hole and an outer conductor of said second bus coaxial cable end is in electrical contact with said block.

2. The fitting of claim 1 in which:

(A) said passage is internally threaded along at least a portion of its length; and (B) said nipple is externally threaded to threadedly engage said passage.

3. A fitting providing access for subsequent tapping into a coaxial cable network comprising:

(A) a block fabricated from a conductive material, said block including:
  1. a cylindrical channel extending between coaxially aligned first and second openings; and
  2. a passage extending between a third opening and said channel, said passage having an axis disposed at right angles with respect to the axis of said first and second openings;

(B) first and second cylindrical insulators having outside diameters dimensioned to be closely received within said cylindrical chamber, each of said first and second insulators extending between an inside face and an outside face;

1. said first cylindrical insulator being positioned within said cylindrical chamber with its said outside face disposed proximate said first opening;
2. said second cylindrical insulator being positioned within said cylindrical chamber with its said outside face disposed proximate said second opening;
3. a first central aperture extending coaxially through said first insulator; and
4. a second central aperture extending coaxially through said second insulator;

(C) a double-ended pin unit fabricated from a conductive material, said pin unit:
1. having a central region and first and second end regions, said central region extending between said first and second end regions;
2. said first and second end regions extending, respectively, into said first central aperture and into said second central aperture such that said pin unit is supported coaxially within said chamber;
3. a first coaxial center-conductor-receiving blind hole in said first end region; and
4. a second coaxial center-conductor-receiving blind hole in said second end region;

(D) a removable cap-off plug adapted to be closely removably received within said passage;

(E) first coaxial cable coupling means adapted to permanently secure a first bus coaxial cable end to said block such that a center conductor of said first bus coaxial cable end extends into said first center-conductor-receiving blind hole and an outer conductor of said first bus coaxial cable end is in electrical contact with said block; and (F) second coaxial cable coupling means adapted to permanently secure a second bus coaxial cable end to said block such that a center conductor of said second bus coaxial cable end extends into said second center-conductor-receiving blind hole and an outer conductor of said second bus coaxial cable end is in electrical contact with said block.

4. The fitting of claim 3 in which:

(A) said passage is internally threaded along at least a portion of its length; and (B) said cap-off plug is externally threaded to threadedly engage said passage.

* * * * *